US009140058B1

(12) United States Patent
James

(10) Patent No.: US 9,140,058 B1
(45) Date of Patent: Sep. 22, 2015

(54) ELEVATED WINDOW COVERING SYSTEM

(71) Applicant: Michael Dana James, Phoenix, AZ (US)

(72) Inventor: Michael Dana James, Phoenix, AZ (US)

( * ) Notice: Subject to any disclaimer, the term of this patent is extended or adjusted under 35 U.S.C. 154(b) by 0 days.

(21) Appl. No.: 14/304,924

(22) Filed: Jun. 14, 2014

Related U.S. Application Data

(60) Provisional application No. 61/956,704, filed on Jun. 14, 2013.

(51) Int. Cl.

| | |
|---|---|
| ***E06B 9/24*** | (2006.01) |
| ***E06B 9/52*** | (2006.01) |
| ***E06B 7/02*** | (2006.01) |
| ***E05C 19/18*** | (2006.01) |

(52) U.S. Cl.
CPC ..... *E06B 9/24* (2013.01); *E05C 19/184* (2013.01); *E06B 7/02* (2013.01); *E06B 9/52* (2013.01); *E06B 2009/527* (2013.01)

(58) Field of Classification Search
USPC ..... 160/369, 371, 104, 40, 96, 92; 52/202
IPC ..... E06B 2009/527; E05C 19/184
See application file for complete search history.

(56) References Cited

U.S. PATENT DOCUMENTS

| | | | | | |
|---|---|---|---|---|---|
| 1,446,364 | A | * | 2/1923 | Wheeler | 292/256.71 |
| 1,977,165 | A | | 10/1934 | Williams | |
| 2,047,366 | A | * | 7/1936 | Fuelle | 160/106 |
| 2,122,130 | A | * | 6/1938 | Dahnert | 292/210 |
| 2,182,983 | A | * | 12/1939 | Goldberg | 49/484.1 |
| 2,321,078 | A | | 6/1943 | Greene | |
| 2,344,357 | A | * | 3/1944 | Kukis | 160/44 |
| 2,508,662 | A | * | 5/1950 | Carper | 292/202 |
| 2,576,777 | A | * | 11/1951 | Clements | 160/40 |
| 2,578,470 | A | * | 12/1951 | Gorell et al. | 52/202 |
| 2,711,789 | A | * | 6/1955 | Boyle et al. | 160/106 |
| 2,716,783 | A | * | 9/1955 | Fegan | 52/202 |
| 2,718,423 | A | * | 9/1955 | Eaddy | 292/256 |
| 2,744,346 | A | * | 5/1956 | Auerbach-Levy | 40/792 |
| 2,889,876 | A | | 6/1959 | Lockhart | |
| 3,146,502 | A | * | 9/1964 | Hahn et al. | 40/792 |
| 3,704,563 | A | * | 12/1972 | Waller | 52/455 |
| 4,044,813 | A | | 8/1977 | Emmons | |
| 4,133,366 | A | | 1/1979 | Jenkins, Sr. | |
| 4,304,082 | A | * | 12/1981 | Peters | 52/507 |
| 4,368,594 | A | * | 1/1983 | Milam et al. | 49/67 |
| 4,630,411 | A | * | 12/1986 | Salzer | 52/1 |
| 4,680,915 | A | * | 7/1987 | Bush | 248/504 |
| 4,724,643 | A | * | 2/1988 | Marsh | 52/509 |
| 6,009,929 | A | | 1/2000 | Linderman et al. | |
| 6,505,669 | B2 | * | 1/2003 | Lilie et al. | 160/371 |
| 7,266,928 | B1 | * | 9/2007 | Stasiak, Jr. | 52/202 |
| 2007/0034343 | A1 | | 2/2007 | Zahka | |
| 2009/0183844 | A1 | | 7/2009 | Alkhoury et al. | |

* cited by examiner

*Primary Examiner* — David Purol
(74) *Attorney, Agent, or Firm* — James L Farmer

(57) ABSTRACT

Methods and apparatus are provided for a device to securely support a solar radiation reducing shade screen in a spaced apart relationship to an underlying window. In one embodiment the device is a discrete spacer configured for permanent attachment to a perimeter frame portion of the window, with a bottom surface adjacent the window frame, and a top surface for supporting a perimeter frame portion of the shade screen above the window frame at a uniform height. The device may further include a clamp attachable to the spacer, and operable between a locked position in which the clamp secures the shade screen frame to the spacer, and a released position in which the shade screen frame is not constrained by the clamp.

20 Claims, 7 Drawing Sheets

FIG. 10
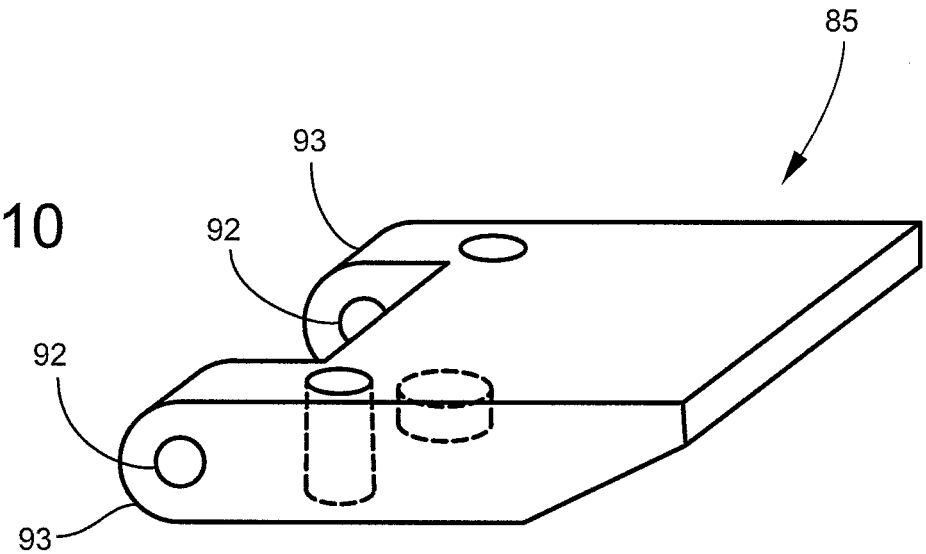
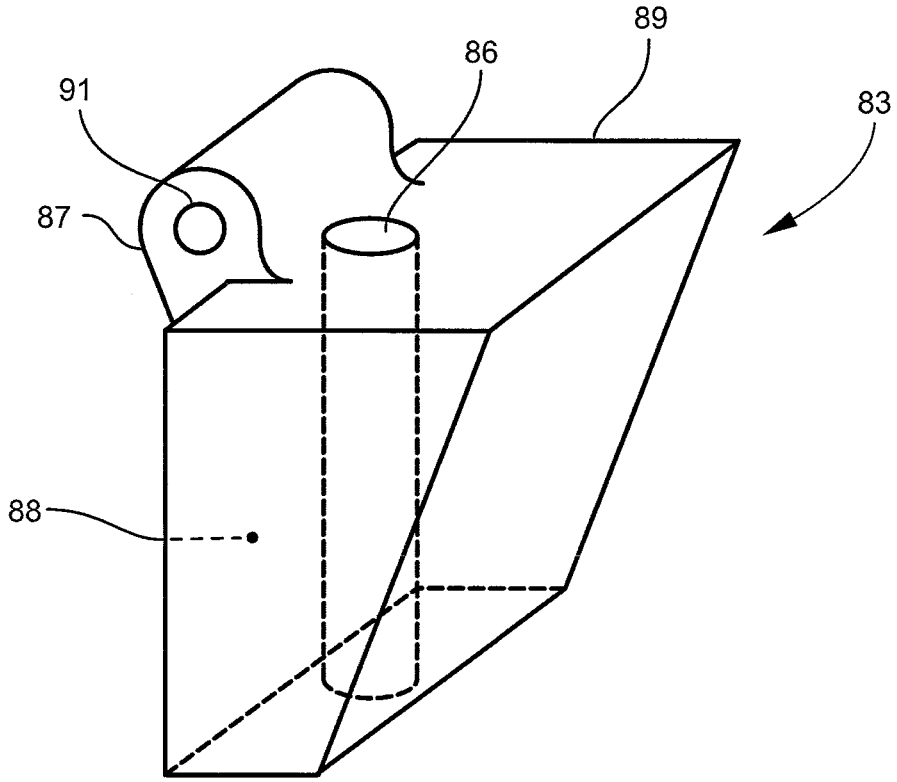
FIG. 11

ELEVATED WINDOW COVERING SYSTEM

Provisional Patent Application Ser. No. 61/956,704, to which the present application claims priority, is hereby incorporated by reference.

TECHNICAL FIELD AND BACKGROUND

The technical field of the present invention generally relates to window screens. The technical field further relates to screens covering the outside surface of a window, including window screens specifically adapted to block a portion of the incident solar radiation from reaching the underlying window surface.

SUMMARY

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment" does not necessarily refer to the same embodiment, although it may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a device for securely supporting a solar radiation reducing shade screen in a spaced apart relationship to an underlying window. The device may include a discrete spacer configured for permanent attachment to a perimeter frame portion of the window. The spacer is configured with a bottom surface adjacent the window frame and a top surface for supporting a perimeter frame portion of the shade screen above the window frame, creating a ventilation gap therebetween. A clamp is attachable to the spacer, and operable between a locked position in which the clamp secures the shade screen frame to the spacer, and a released position in which the shade screen frame is not constrained by the clamp.

According to another embodiment, a system is provided for reducing the transmission of radiant solar energy through an exterior window of a building structure. The system may include a plurality of window covering mounts attached at discrete locations to a perimeter frame portion of the exterior window. A shade screen is securely supported on the window covering mounts above the window, providing a ventilation gap substantially around the entire perimeter of the shade screen.

In yet another exemplary embodiment a system is provided for securely supporting a window shade screen in a spaced apart relationship to an underlying window. The system includes a plurality of discrete spacers distributed about a perimeter frame portion of the window between the window frame and a perimeter frame portion of the shade screen, defining a uniform ventilation gap between the window frame and shade screen frame. A clamp is associated with each spacer and operable between a locked position in which the clamp secures the shade screen frame to the respective spacer, and a released position in which the window shade screen is unconstrained by the clamp Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

In the accompanying drawings:

FIGS. 8 through 11 depict a two-piece spacer with a fixed portion attached to the window frame, and a hinged portion for supporting a shade screen frame.

DESCRIPTION OF THE EMBODIMENTS

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
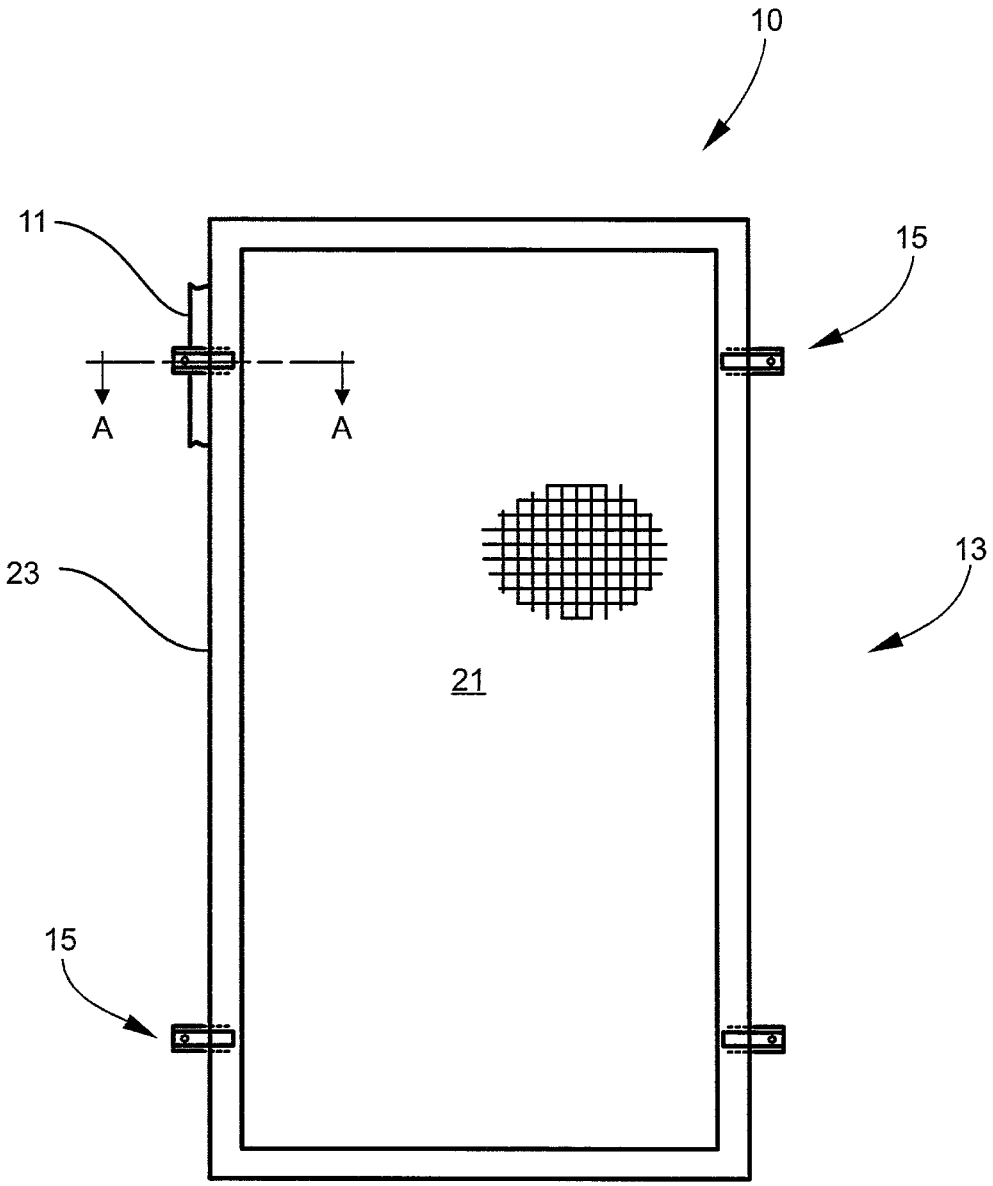
FIG. 1 is an top view of a shade screen supported at four locations using the elevated window covering system of the present disclosure.
Figure 2:
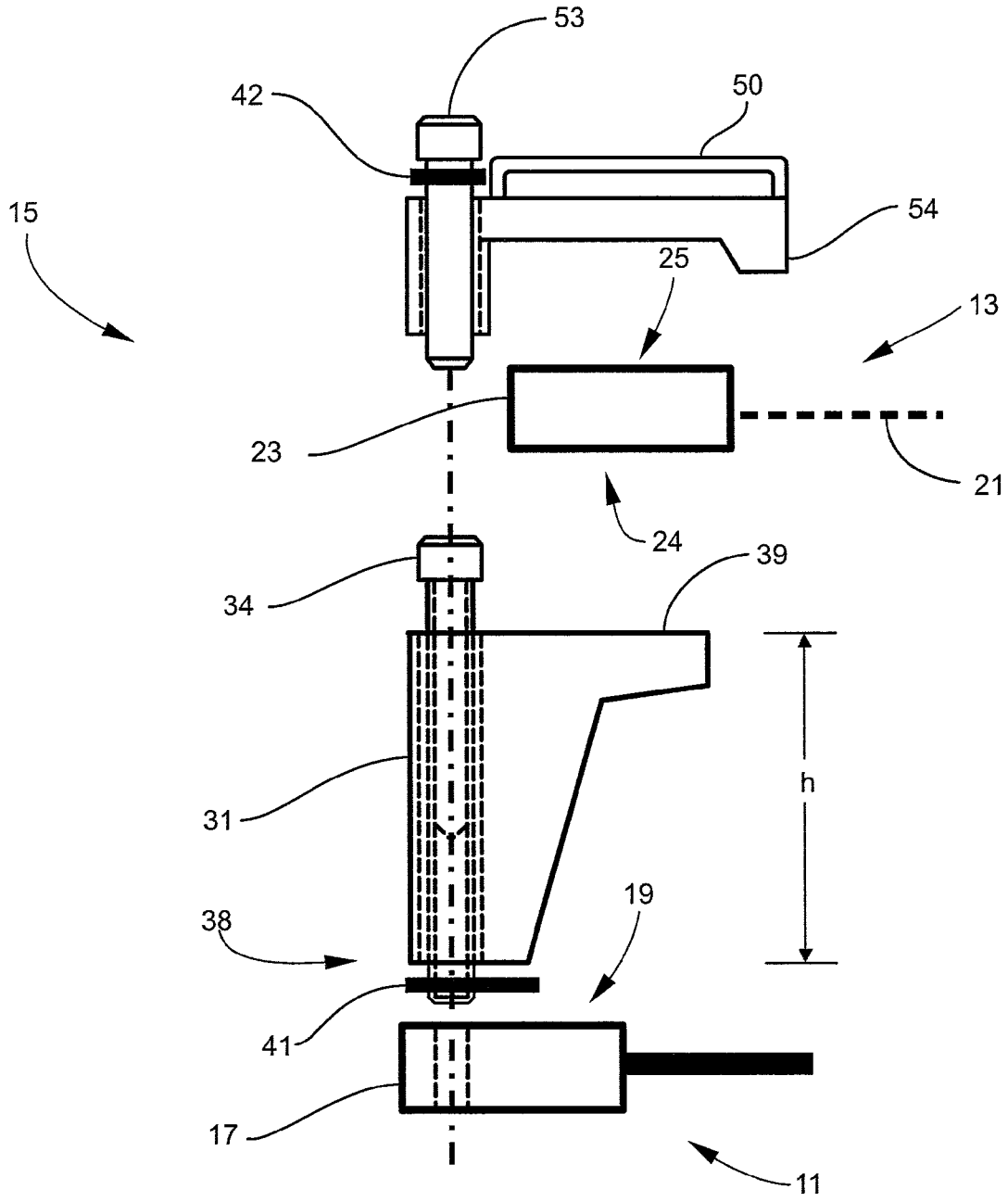
FIG. 2 is an exploded cross section through the elevated window covering system of FIG. 1 at arrows A-A.

Referring now to the drawing figures and in particular to FIGS. 1 and 2, an exemplary elevated window covering system in accordance with the present disclosure is indicated generally at reference numeral 10. The exemplary system involves a window 11, a window covering 13, and a plurality of discrete window covering mounts 15 securing the window covering to the exterior side of the window in a spaced apart relationship. The window 11 may be for example a single, double, or triple pane glass window, gas filled or with reflective coatings, in an exterior surface or wall of any structure such as a vehicle or building, including primarily transparent structures such as sunrooms and greenhouses. The window covering 13 may be any type of external window treatment, such as any of various conventional window screens or shades. In one particular embodiment the window 11 is a window in an exterior wall of a building structure, consisting generally of a window frame 17 with an exposed outside surface 19; and the window covering is a window screen consisting of a screen mesh 21 mounted in a frame 23.

In a more particular embodiment the window screen is characterized by a type of screen mesh specifically adapted to block a substantial portion of incident solar radiation from reaching the underlying window, and thereby reduce the amount of radiant heat transferred through the window. Such specially adapted window screens are well known and ubiquitous on residential and commercial structures in relatively hot and arid climates such as the southwest United States, or other regions where temperatures frequently exceed 90 degrees Fahrenheit. Commonly used terminology includes "sun screen", "shade screen", "solar screen", "solar shade screen", "radiation screen", and other combinations of those and like terms. For the sake of consistency, the term "shade screen" will be used throughout this disclosure. A significant distinction between shade screens and conventional window screens is that shade screens are useful to reduce the solar radiation and reduce heat transfer into the structure or vehicle. Thus, shade screens are commonly installed on windows for the sole purpose of reducing the solar heat load on the window.

While such screens are known to be effective at reducing transmission of radiant solar energy, the present inventors have discovered that shade screens in currently existing installations have the adverse effect of increasing the surface temperature of the underlying window glass and window frame, causing increased conductive heat transfer through the window and frame. Tests were performed in which glass and frame temperatures of various window frame configurations were measured under identical external conditions, both with and without conventionally installed shade screens present. It was confirmed that the glass and frame temperatures of the windows that were covered with the shade screen were consistently higher than those of the uncovered, exposed windows.

As discovered by the inventors, the elevated glass and frame temperature is largely attributable to the manner in which shade screens are typically installed. In a typical installation the screen frame is attached directly to the window frame in the manner of a conventional window screen installation. Thus, as in a conventional window screen installation, outside air must pass through the screen mesh in order to reach the surface of the window. The inventors realized that in such an installation the screen tends to act as a barrier, interfering with the ambient airflow across the window and limiting the naturally occurring convective cooling. Consequently, the ability of the window to dissipate heat through natural convection is reduced when the conventionally installed solar screen is present, resulting in higher glass temperature. Additionally, the direct mount of typical shade screens results in a relatively high level of conductive heat transfer from the externally exposed shade screen frame to the window frame, and hence into the structure or vehicle.

Figure 3:
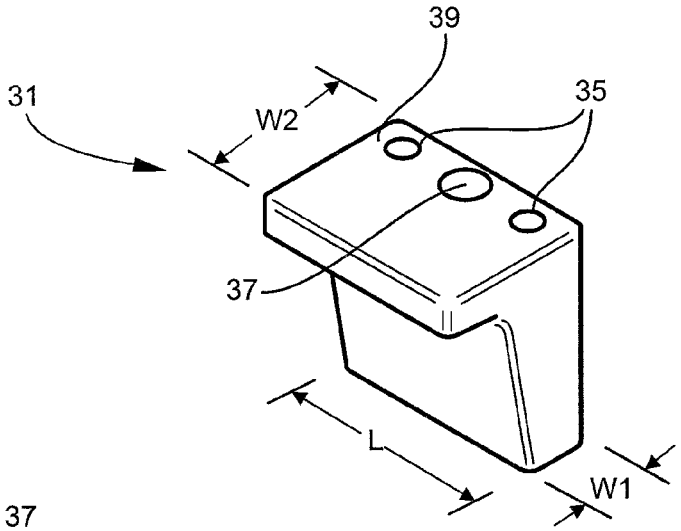
FIG. 3 is a perspective view of a one-sided "L"-shaped spacer portion of the elevated window covering system.
Figure 4:
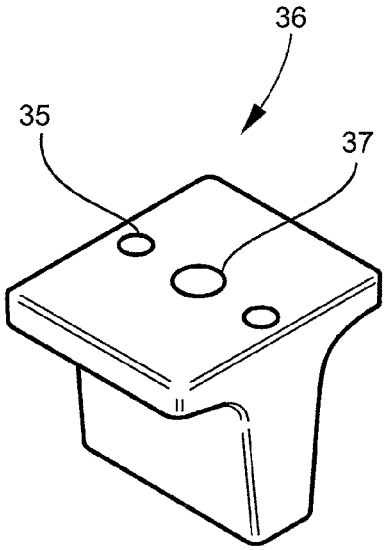
FIG. 4 is a perspective view of an exemplary two-sided "T"-shaped spacer portion of the elevated window covering system.

Regardless as to the exact nature of the physical phenomena at work, and without being limited to any particular theory, the present inventors further discovered that the above described adverse temperature effect can be substantially counteracted by mounting the window covering in spaced apart relationship with the window frame such that a uniform ventilation gap is provided between the window and window covering frames around substantially the entire perimeter of the window covering. Referring now to FIGS. 2 through 4, the spaced apart relationship may be accomplished by utilizing the unique window covering mount 15. In the depicted embodiment the mount 15 comprises generally a spacer 31, a clamp 50, and fasteners 34 and 53. The spacer 31 is disposed between an inside surface 24 of the window shade screen and the outside surface 19 of window frame 17, and may be any type of rigid block or post type member capable of supporting the window covering 13 in a stable and elevated position above the window. The length 'L' of the spacer in a direction parallel to the underlying window frame is finite, and a small fraction of the total length of any one side of the window to avoid interference with convective air flow. For example, in one particular embodiment the length of the spacer is approximately 1 inch.

The height "h" of the spacer determines the size of the ventilation gap between the window covering and the window. Generally speaking it is preferable to minimize the standoff height of the window covering in order to minimize the amount of window surface exposed to direct sunlight when the window is not directly facing the sun. In one preferred embodiment the height is selected to be the minimum necessary to provide substantially optimal system efficiency at a given window aspect ratio and orientation. By one measure "optimal system efficiency" may refer to a height "h" at which any further increase produces no significant convective heat removal benefit. Alternatively, it may mean a height "h" at which the total heat flux passing through the underlying window is minimized. In one exemplary embodiment the spacer height "h" is between about two tenths inch and three inches, and in a more particular embodiment the height is about one inch.

The spacer may be made of any durable and rigid material, such as various metals, plastics, or composites, including recycled plastics or aluminum. In one embodiment the spacer is made of aluminum, and is cast or machined to the desired shape. In another, it is made of a UV resistant polymer. The spacer 31 may be permanently attached to the window, such as with a single threaded fastener 34 passing through bore 37 and anchored into to the window frame 17. As shown in FIG. 1, a typical four-sided window covering may be adequately supported using one such spacer near each corner of the window.

In the depicted embodiment the spacer 31 is somewhat "L" shaped, with a relatively narrow base 38, and a substantially wider top 39 for supporting the window covering frame 23. The relatively narrow base has the beneficial effect of reducing the available surface area for conductive heat transfer to the window frame 17. In one embodiment the width "w1" (see FIG. 3) at the base end 38 of the spacer is less than one third the width "w2" at the top 39. Conductive heat transfer may be further reduced by incorporating a thermally insulative sealing material between the spacer and window frame, such as the insulative gasket 41 shown. Gasket 41 and a sealing washer 42 may also serve to create a seal and prevent moisture egress into the window frame or glass where fastener 34 anchors into the window frame.

Shown in FIG. 4 is a two-sided, or generally "T" shaped spacer 36. While the spacer shown in FIGS. 2 and 3 can support one window covering frame, the T-shaped embodiment of FIG. 4 may be used to simultaneously support two adjacent window coverings on closely adjacent windows. Although shown symmetrical, such an embodiment may be configured with one side extending further than the other, as may be required for any particular installation.

Figure 5:
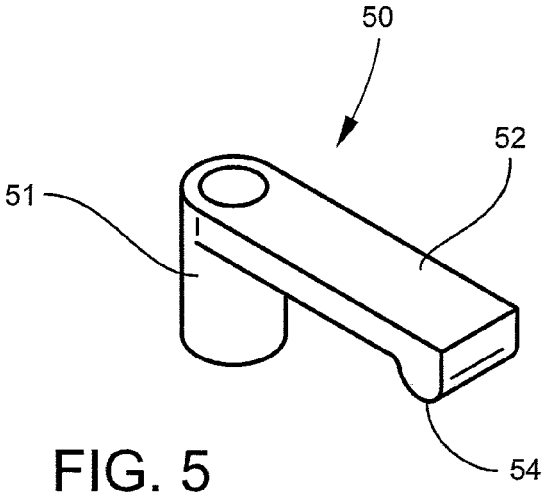
FIG. 5 is a perspective view of a clamp portion of the elevated window covering system for securing a shade screen frame to a spacer.
Figure 6A:
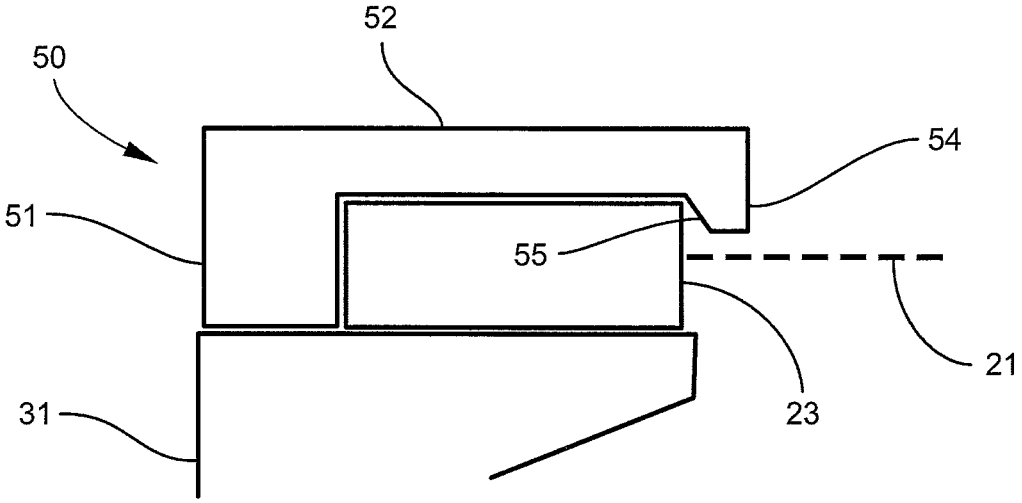
FIGS. 6A and 6B are cross section views of two embodiments for capturing a shade screen frame to a spacer.

Referring now also to FIGS. 5 and 6A, the window covering is secured to the top of the spacer 31 using clamp 50. The clamp is generally "L" shaped, with a columnar base section 51, and a clamp arm 52 extending laterally away from an upper portion of the base section. The clamp may be attached to the spacer using a fastener 53 that passes through the base section 51 and screws into a threaded hole 35 in the top of the spacer (see FIGS. 2 and 3). The top of spacer 31 may be large enough to accommodate more than one clamp 50. For example, in the embodiment of FIG. 3 the spacer 31 is configured with two threaded holes 35 for attaching two clamps, one on either side of the spacer fastener 34.

Clamp 50 is configured such that when the fastener 53 is tightened, the clamp arm 52 bears down against the top surface 25 of window covering frame 23, thereby clamping the window covering frame to the spacer. The clamp arm may further include a capture feature in the form of a downward depending flange 54 at the free end of the arm. The capture feature is positioned so that a window covering frame 23 can fit between the flange 54 and the base section 51 (see FIG. 6A). The flange 54 thus effectively creates a pocket, capturing window covering frame 23 against the spacer 31. The inside edge of flange 54 may include a bevel 55 as shown to ease installation and prevent the flange from catching on or damaging the window covering frame. Bevel 55 may also be configured such that the space between the clamp base section 51 and an upper portion of the bevel is slightly less than the width of the window covering frame 23, resulting in the window frame being squeezed against the base section 51 when fastener 34 is tightened. In one such embodiment the bevel angle is in the range of about 5 to 25 degrees.

Figure 6B:
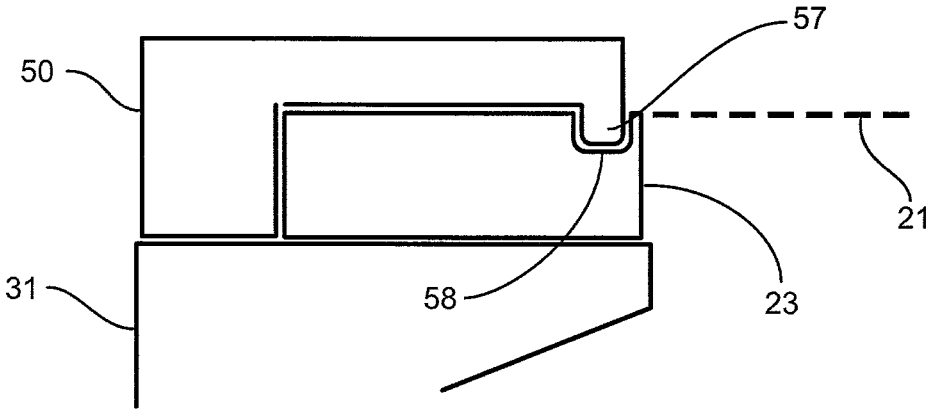

FIG. 6B illustrates another embodiment in which the clamp is configured to engage a shade screen of the type with the screen mesh mounted flush to the screen frame using an O-ring in a screen mesh retention groove. In this embodiment a rounded or cylindrically shaped capture flange 57 is configured to align with the standard O-ring groove 58. By tightening down the fastener holding the clamp to the spacer, the flange 57 is forced down into the groove 58 as shown, positively securing the screen frame. The clamp embodiment of FIG. 6B may be effectively used with or without the O-ring present in the portion of the groove under the clamp. The same clamp may also be used in the manner previously described in reference to FIG. 6A to simply capture the inside edge of a properly configured screen frame.

In the above described embodiments the window covering is configured in the manner of a conventional window screen in the sense that the window covering frame is sized to sit directly atop the window frame. Accordingly, the elevated window covering system of the present disclosure may be beneficially used with retrofit installations to elevate a conventionally mounted existing window covering. However, the system of the present disclosure may also be used to implement a unique configuration in which the window covering is not the same size as the window, and the window covering frame does not sit directly atop the window frame.

Figure 7:
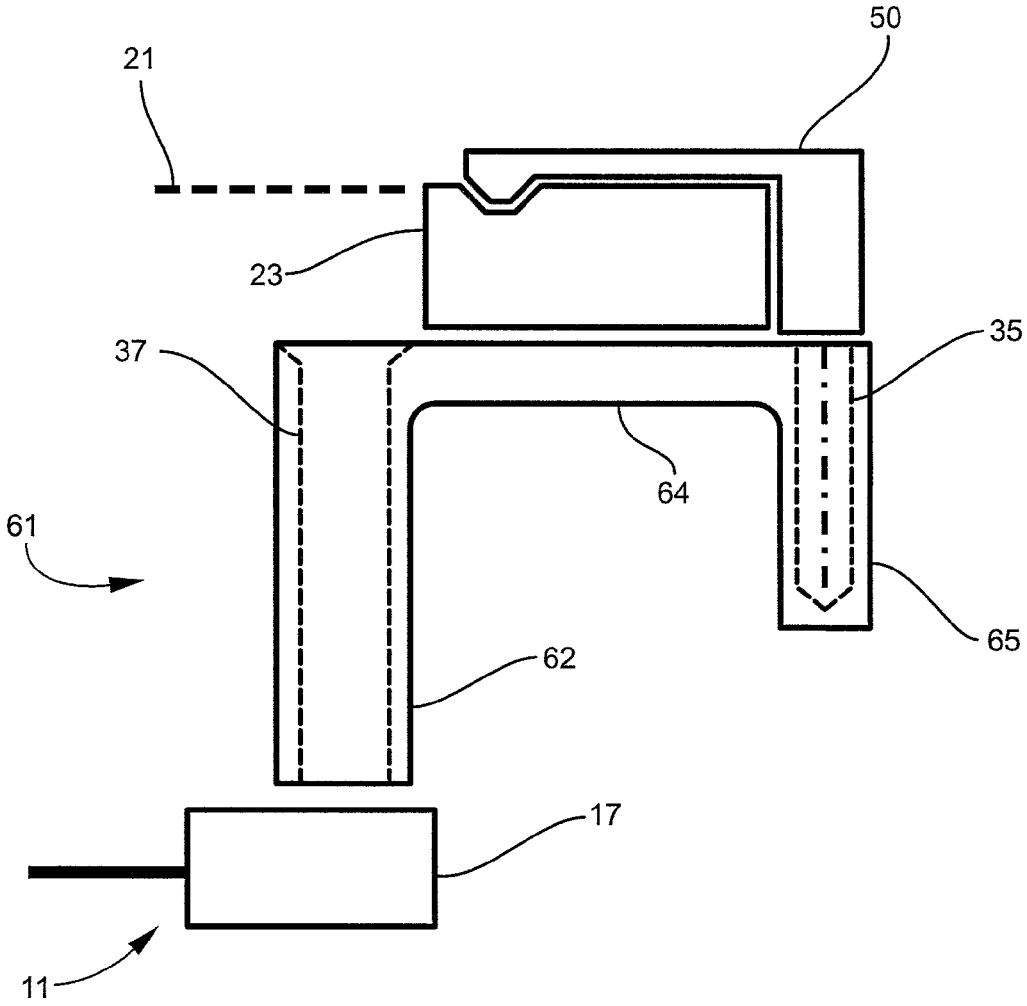
FIG. 7 is a cross section view showing an elevated window covering system for supporting a shade screen that is larger than the underlying window.

An example of one such configuration in which the window covering frame is substantially larger than, and actually overhangs the window frame, is shown in FIG. 7. Compared to a conventionally sized screen, a configuration of this type tends to ensure that the entire underlying window remains shaded for a larger portion of the daylight hours and at oblique sun angles, which results in further reduced heat transfer. Referring to the drawing, an extended spacer 61 is attached to the window frame, for example in the manner described above using a threaded fastener 34 inserted through hole 37 and screwed into the window frame 17. However instead of the top surface of the spacer extending inward, toward the center of the window as in the embodiments of FIGS. 1 through 6, the top surface 69 of spacer 61 extends in the opposite direction, away from the window. As shown, the extended top surface provides a platform for the window covering frame substantially outside the underlying window frame.

Like the previously disclosed spacer embodiments the extended spacer 61 may be configured to minimize the surface contact area with the underlying window frame for minimizing heat conduction. In the depicted embodiment this is accomplished by giving the spacer a channel shape, with inner and outer vertical flanges 62, 65 forming the sides of the channel, and a laterally extending platform portion 64 forming the base of the channel. The platform portion 64 may extend far enough to allow room for attaching a clamp 50 to the top surface 69 of the spacer beyond the window covering frame 23. For example, in the depicted embodiment the outer flange 64 is outboard of the window covering frame and includes threaded holes 35 for attaching a clamp 50 in the manner described above. Although not depicted, it should be appreciated that various fasteners, clips or other means for attaching a clamp or securing the window covering to extended spacer 61, or to any of the disclosed spacer embodiments, are contemplated and foreseeable within the scope of the present disclosure.

Figure 8:
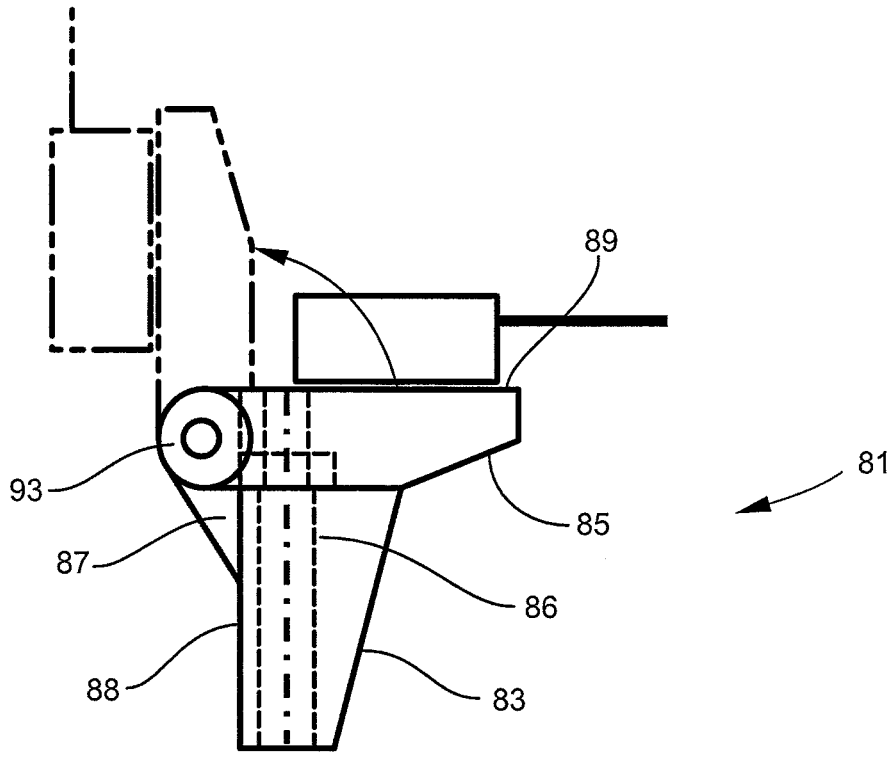
Figure 9:
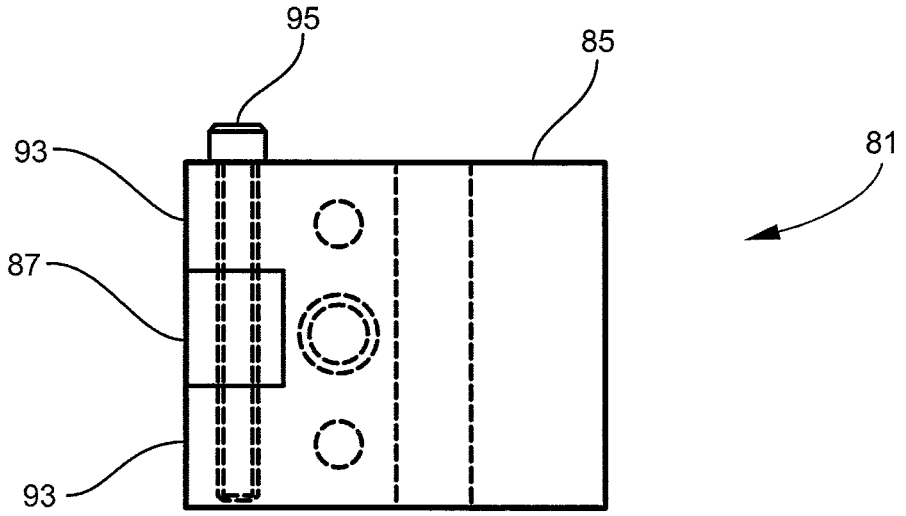

FIGS. 8 through 11 illustrate another embodiment in which the spacer doubles as a hinge, allowing the window covering to swing open about one edge for conveniently accessing the underlying window. In particular, a hinged spacer 81 comprises a fixed base portion 83 that is attached to the window frame, and a moveable platform portion 85 that is pivotally mounted atop the base portion 83. The base portion 83 may be attached to the window frame in the same manner as described above in reference to FIG. 2, for example by bolting it down using a threaded fastener inserted through a hole 86 in base portion 83. A middle hinge flange 87 extends up from the outside surface 88 of base portion 83 and projects above a top surface 89 of base portion between two outer hinge flanges 93 extending from the moveable platform portion 85. A hinge pin 95 inserted through aligned bores 91 and 92 in flanges 87 and 93 completes the hinge, allowing the platform portion 85 to pivot away from the top of the base portion, as indicated in FIG. 8. The top surface of platform portion 85 acts as the top of the spacer, providing a supporting surface for the window covering frame, and means for securing the widow covering frame, such as a clamp 50. Thus when the moveable platform portion 85 is pivoted away from the base portion 83, the window covering frame goes with it.

Accordingly, the hinged embodiment may be utilized by mounting at least one edge of a window covering using the hinged spacer 81. As long as the other edges of the window frame are locked down, such as with clamps 50, the window covering is secure, and prevented from moving. However by releasing the clamps holding down the other edges, but not the clamps securing the hinged edge, the window covering may be swung away from the underlying window, just like any hinged window or door. Moreover, by using the hinged spacer 81 exclusively at every edge of the window covering, any edge may become the hinged edge by simply releasing the other edges.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A device for securely supporting a solar radiation reducing shade screen in a spaced apart relationship to an underlying window, comprising:

a discrete spacer configured for permanent attachment to a perimeter frame portion of the window with a first fastener, the spacer having a bottom surface adjacent the window frame, and a top surface for supporting a perimeter frame portion of the shade screen above the window frame, creating a ventilation gap there-between; and a clamp attachable to the spacer with a second fastener, and operable between a locked position in which the clamp secures the shade screen frame to the spacer, and a released position in which the shade screen frame is not constrained by the clamp.

2. The device of claim 1, wherein the ventilation gap between the shade screen frame and the window frame is at least two tenths inch.

3. The device of claim 2, wherein the ventilation gap between the shade screen frame and the window frame is about one inch.

4. The device of claim 1, wherein the first fastener is a threaded fastener inserted through the spacer and threaded into the window frame.

5. The device of claim 1, wherein the clamp comprises a columnar base portion attachable to the top surface of the spacer, and an arm portion extending laterally away from the base portion, the arm portion configured to overlap and bear down upon the shade screen frame when the second fastener is tightened.

6. The device of claim 5, wherein the clamp further comprises a downward depending capture flange at a free end of the arm portion, the capture flange configured to lock the shade screen frame in place on the spacer.

7. The device of claim 6, wherein the clamp is configured such that the capture flange aligns with a screen mesh retention groove in a top surface of the shade screen frame, and tightening the second fastener forces the capture flange into the screen mesh retention groove.

8. The device of claim 7, wherein the capture flange has a semicircular shape in cross section.

9. The device of claim 1, wherein the spacer comprises a fixed base portion attached to the window frame, and a pivotally moveable platform portion atop the base portion, the platform portion adapted for securely supporting the shade screen frame.

10. The device of claim 9, wherein the moveable platform is pivotally connected to the spacer about an axis parallel to the underlying window frame, and moveable between a closed position in which a top surface of the moveable platform is generally parallel to the underlying window surface, and an open position in which the platform has pivoted away from the underlying window surface.

11. A system for reducing the transmission of radiant solar energy through an exterior window of a building structure, comprising:

a plurality of window covering mounts attached at discrete locations to a perimeter frame portion of the exterior window; and a shade screen securely supported on the window covering mounts above the window such that a uniform ventilation gap is provided substantially around the entire perimeter of the shade screen, wherein the window covering mounts each comprise a spacer adapted for attachment to the window frame using a first fastener, and a clamp attached to the spacer with a second fastener, the clamp operable to secure the shade screen to the spacer.

12. The system of claim 11, wherein a perimeter frame portion of the shade screen is securely attached to the window covering mounts, and the uniform ventilation gap is between about two tenths inch and three inches.

13. The system of claim 12, wherein the uniform ventilation gap between the shade screen frame and the underlying window frame is about one inch.

14. The system of claim 11, wherein the clamp is operable between a locked position in which the clamp secures a frame portion of the shade screen to the spacer, and a released position in which the shade screen is unconstrained by the clamp.

15. The system of claim 11, wherein the clamp comprises a base portion attachable to a top surface of the spacer, and an arm portion extending laterally away from the base portion, the arm portion configured to overlap and bear down upon the shade screen frame when the second fastener is tightened.

16. The system of claim 15, wherein the clamp further comprises a downward depending capture flange at a free end of the arm portion, the capture flange configured to lock the shade screen frame in place on the spacer.

17. A system for securely supporting a window shade screen in a spaced apart relationship to an underlying window, comprising:

a plurality of discrete spacers distributed about a perimeter frame portion of the window between the window frame and a perimeter frame portion of the shade screen, the spacers defining a uniform ventilation gap between the window frame and shade screen frame, wherein the spacers are each attached to the window frame using a first fastener; and a clamp attached to each spacer with a second fastener and operable between a locked position in which the clamp secures the shade screen frame to the respective spacer, and a released position in which the window shade screen is unconstrained by the clamp.

18. The system of claim 17, wherein the ventilation gap between the window frame and shade screen frame is optimized to minimize the total solar induced heat flux through the underlying window.

19. The system of claim 17, wherein the ventilation gap between the window frame and shade screen frame is minimally sized such that any increase in the gap produces no significant convective heat removal benefit to the underlying window.

20. The system of claim 17, wherein the ventilation gap between the window frame and shade screen frame is about one inch.

* * * * *